United States Patent [19]

Hegarty

[11] 4,183,595

[45] Jan. 15, 1980

[54] APPARATUS FOR FILLING GLASS TUBING WITH PURE GAS

[75] Inventor: William Hegarty, New Rochelle, N.Y.

[73] Assignee: Self-Powered Lighting, Ltd., New York, N.Y.

[21] Appl. No.: 927,252

[22] Filed: Jul. 21, 1978

[51] Int. Cl.[2] ..... H01J 9/385; H01J 9/395

[52] U.S. Cl. ..... 316/30; 316/20; 316/24

[58] Field of Search ..... 316/20, 24, 30; 141/8, 141/66; 53/79, 408, 432, 510

[56] References Cited

U.S. PATENT DOCUMENTS

| | | | |
|---|---|---|---|
| 2,764,858 | 10/1956 | Cook | 53/432 |
| 2,793,480 | 5/1957 | Shorten et al. | 53/408 |
| 3,572,877 | 3/1971 | Ogawa et al. | 316/24 |
| 3,577,697 | 5/1971 | Preacher | 316/20 |
| 3,788,724 | 1/1974 | Schenkels et al. | 316/20 |

*Primary Examiner*—John McQuade

*Attorney, Agent, or Firm*—Blum, Kaplan, Friedman, Silberman & Beran

[57] ABSTRACT

In the filling of small-bore tubing with a gas under conditions such that the purity of the gas is maintained during the filling operation, a pump-head having large interior and exterior conduits connectable to a high-speed high-vacuum pump provides for rapid evacuation. The tubing can be heated for removal of traces of oxygen-containing contaminants from the interior thereof. Filling is effected by means of small-bore tubing; a valve-plug permits sealing-off of the major portion of the interior conduit so that the volume of the gas remaining in the interior of the pump-head subsequent to the filling operation is small. The pressure in glass tubing is reduced below atmospheric by immersing the tubing in a suitable chilling mixture, thereby making it possible to seal off the tubing by heating it to fusion and allowing it to collapse. The tubing to be filled with gas may be held in a casting which fits to the pump-head sealingly.

7 Claims, 4 Drawing Figures

APPARATUS FOR FILLING GLASS TUBING WITH PURE GAS

BACKGROUND OF THE INVENTION

In the filling of small-bore tubing with a pure gas, and where it is desirable that the purity of the gas be maintained, the small-bore tubing must first be evacuated. In general, such small-bore tubing is fitted to vacuum equipment of the same general diameter, such equipment having conduits therein of high impedance, so that the pumping operation is necessarily slow. Needless to say, such a system is unsuitable for large-scale production. In addition, depending upon the particular gas to be introduced into the tubing and on the composition of the tubing, it may be necessary to bake out the tubing prior to filling same. Finally, where the tubing is of glass, it is necessary to provide a join between the tubing and the vacuum equipment which is hermetic and which permits sealing-off of the tubing at the end of the procedure so that the glass tube is closed at both ends. As is evident, an apparatus and a method for carrying out such a procedure is highly to be desired.

SUMMARY OF THE INVENTION

An apparatus for filling a single tube or a plurality of tubes simultaneously with a gas of high purity and maintaining the purity thereof during the filling operation includes a pump-head having a large interior conduit therethrough, such a conduit having low impedance for the transit of gas therethrough. The pump-head also includes an exterior conduit of large diameter for connection to a high-speed high-vacuum pump. Moreover, the pump-head includes a small-diameter conduit having a valve therein through which a gas with which the tubing is to be filled is introduced.

At one end of the interior conduit is a port and a clamp ring. The tubing to be filled is preferably mounted in a casting which fits sealingly against said port and is held thereto by said clamp ring. A valve plug within the interior conduit is movable between first and second positions. In said first position, said exterior conduit communicates with said port and said tubing to be evacuated through said interior conduit. In said second position, said valve plug separates said port from the major portion of said interior conduit and from said exterior conduit. Further, said valve plug in said second position connects said small-diameter conduit with said port and said tubing to be filled through a minor portion of said interior conduit, the volume of said interior conduit available for transit of gas from said small-diameter conduit to said port being small, thereby minimizing the amount of gas remaining in said conduit subsequent to filling said small-bore tubing.

After filling said tubing, said tubing may be sealed off as by pinching same or by fusion when said tubing is of glass.

Where said tubing is of glass, it is necessary that the pressure therein be lower than that on the exterior of said tubing. This condition may be achieved by raising the pressure on the exterior of said tubing to a sufficiently high level, but, in general, it is preferable to drop the pressure on the interior of the tubing by surrounding said tubing with a chilling means such as liquid nitrogen. Under such circumstances, the glass will collapse when heated in a zone surrounding same.

Where the tubing is of glass and has a phosphor therein, it is necessary that all traces of oxygen-containing contaminants be removed since such contaminants can react with and degrade the phosphor. For this purpose, an oven is provided for heating said tubing during the evacuation process. The apparatus and process are particularly useful for filling glass tubing having a phosphor coating on the interior thereof with a radioactive gas such as tritium or krypton.

A means for holding said tubing sealingly against the port of the pump-head is a casting which is formed about the open end of tubing sealed at the other end, the casting being formed in such a way that it does not block the open end of the tubing. A mold and mounting means are provided for holding the tubing with the open end against the surface of the mold so that a casting can be formed around the tubing without entry of the casting material into the open end of the tubing. A preferred material for this casting is of tin-indium, such a material having a high surface tension which helps to prevent entry of said casting material into the open end of the small-bore tubing during the casting operation.

Accordingly, an object of the present invention is an apparatus for filling small-bore tubing with a gas of high purity and for maintaining the purity of said gas during the filling operation.

Another object of the present invention is an apparatus for evacuating small-bore tubing at high rate prior to a filling operation.

A further object of the present invention is an apparatus for baking out small-bore tubing during an evacuation step which is carried out prior to filling said small-bore tubing with a pure gas.

An important object of the present invention is an apparatus for mounting tubing sealed at one end in preparation for filling said tubing through the other end.

A significant object of the present invention is an apparatus for filling small-bore glass tubing with a pure gas while maintaining the purity of said gas, the rate of preparation of said tubing for filling and the filling operation being effected rapidly so that the apparatus and process for filling said tubing are suitable for high-rate production.

Related to the present invention is a method of preparing small-bore tubing for filling with a gas of high purity and maintaining the purity of said gas during the filling operation.

Also related to the present invention is a method of mounting small-bore tubing for joining to a high-speed high-vacuum apparatus for preparation for filling and for filling with a gas of high purity while maintaining the purity of said gas during the preparation and filling steps.

Also related to the present invention is a casting of a metal of low vapor pressure and high surface tension for holding small-bore tubing during a filling operation.

Still other objects and advantages of the invention will in part be obvious and will in part be apparent from the specification.

The invention accordingly is related to the several steps and the relation of one or more of such steps with respect to each of the others, and comprises the apparatus embodying features of construction, combinations of elements and arrangement of parts which are adapted to effect such steps, all as exemplified in the following details disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
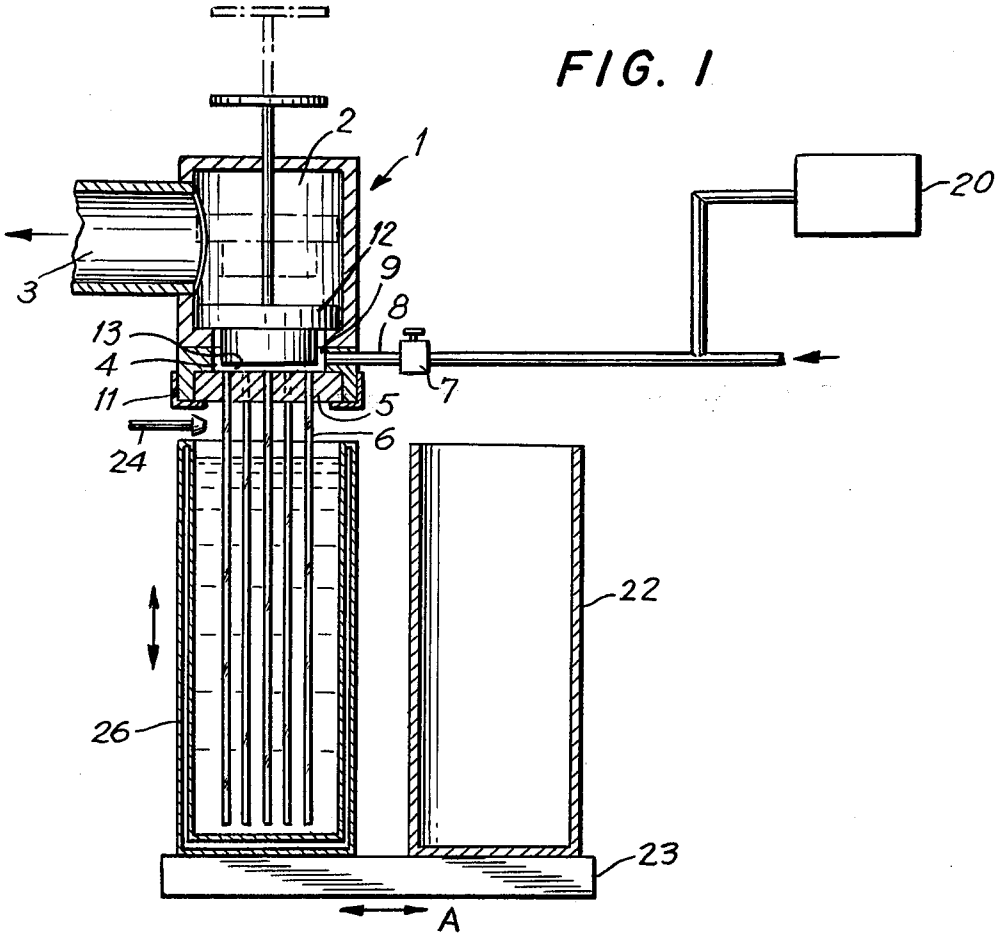
FIG. 1 shows diagrammatically the apparatus of the present invention with tubes in place for filling.

An apparatus for evacuating and filling small-bore tubing with a gas at high purity is shown in FIG. 1 in which a pump-head, indicated generally by the reference numeral 1, has an internal conduit or passage 2 of large diameter and an external conduit 3 for connection to a high-vacuum, high-speed pump. Conduit 2 ends in a port 4 to which can be fitted a tube-holder 5 carrying at least one, and, preferably, a plurality of small-bore tubes 6 to be evacuated and filled.

The gas with which the tubes are to be filled is introduced from a source (not shown) through valve 7 and small-diameter conduit 8, said small-diameter conduit 8 joining internal conduit 2 at junction 9. Tube-holder 5 fits sealingly against port 4 and is held thereto by clamp ring 11. Valve plug 12 is movable between an upper position (shown in dashed lines) and a lower position. In said upper position, the small diameter tubes are connected to the external vacuum pump through large-diameter conduits 2 and 3 for rapid evacuation to a low pressure. Small-diameter conduit 8 is also evacuated at the same time. When moved to the lower position, the major portion of the pump-head is isolated from the small-bore tubing, small-diameter conduit 8 communicating with small-bore tubes 6 through the portion 13 of internal conduit 2, said portion 13 being of small volume. Preferably, the clearance between valve plug 12 and the wall of internal conduit 2 is about 0.020 inches. It is advantageous that portion 13 be of small volume to minimize the quantity of gas remaining in the pump head after filling of the small-bore tubes. This quantity of gas can be retrieved through valve 7 by the use of an appropriate scavenger indicated by the reference numeral 20.

Figure 2:
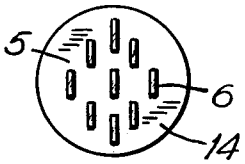
FIG. 2 is a top view of a tube holder.

Although a single tube may be filled by the apparatus of the present invention, it is preferable for obvious reasons to fill a substantial number of tubes in a single operation. The tubes may be rectangular in shape as shown in FIGS. 2 and 3 and are conveniently arranged in the tube holder 5 leaving a margin 14 to seat against port 4.

Figure 3:
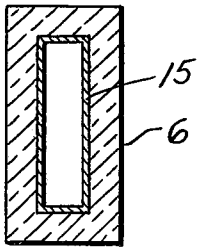
FIG. 3 is a view in transverse section of a glass tube having a phosphor coating on the interior thereof.

In a particularly important method of use of the apparatus of subject invention, small-bore tubes 6 may have an interior coating 15 of a phosphor thereon, such a tube being shown in section in FIG. 3. The small-bore tubes 6 may be arranged as shown in FIG. 2 with the major surfaces of the tubes parallel to each other.

Figure 4:
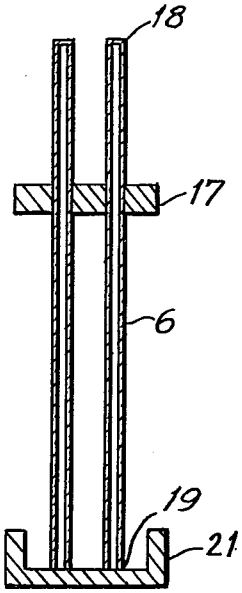
FIG. 4 is a view of a casting mold for preparation of a tube holder.

As will be evident from FIG. 1, the top end of each of the tubes 6 held in tube holder 5 is flush with the upper surface thereof. Also, the upper end of each tube is open and unimpeded by any portion of the tube holder 5. A preferred method of mounting the tubes 6 in tube holder 5 can be understood from FIG. 4 which shows the small-bore tubes held in temporary support 17, each of the tubes 6 having a closed end 18. The open end 19 is held flush against the upper surface of mold 21. A casting material which may be a resin, either natural or synthetic, or a castable alloy (not shown) is then poured into the mold to form a tube holder which seals hermetically against the outside of each tube. Preferably, an alloy such as tin-indium alloy having a low vapor pressure is used. It is also desirable that the material have a high surface tension so that it does not tend to flow into the open end of the tube.

After cooling, the tube holder with the small-bore tubing embedded therein, is brought against port 5 and is sealed thereto by the pressure of clamp ring 11.

In preparation for filling a tube with the desired gas, valve 7 is shut and valve plug 12 is raised to the upper position, thereby providing communication for gas flow between external conduit 3 and the small-bore tubes. Pumping is continued until a desired low pressure which may be $10^{-5}$ mm or lower is reached. Where the small-bore tubes are of glass, and, more specifically, of a borosilicate glass such as pyrex, and have a phosphor on the interior surface thereof, the removal of oxygen-containing contaminants from the surface of the glass is facilitated by raising the temperature thereof. For this purpose, an oven 22 is provided, oven 22 being supported on platform 23. Platform 23 can be dropped, if necessary, so that the top of oven 22 is below the bottom ends of the tubes, then moved to one side as indicated by the horizontal double arrow having the the reference character A and then raised into position for heating the tubes. Heating may be carried out simultaneously with pumping. The temperature to which the tubing is raised, in general, should be at least 400° C. and, preferably, is about 500° C.

Following the pumping step, whether heating is used or not, plug valve 12 is lowered to disconnect the pump from the small-bore tubes. If the tubes have been heated, they are allowed to cool. Valve 7 is then opened and gas is introduced into the tubes until a desired pressure is reached, the pressure, in general, being above atmospheric.

Where the tubes are of glass, they are chilled sufficiently to bring the pressure in the tubes below atmospheric pressure and they are then sealed off proximate the tube holder 5 by raising the temperature of the glass at this zone to the fusion point, the tubes then being separable from the tube holder, thus completing the operation. A convenient method of sealing off the tubes is by the use of a fine torch indicated by the reference numeral 24. However, sealing by means of a hot wire, or the like, is also possible. As for the chilling step, this is most conveniently carried out by the use of liquid nitrogen in a Dewar flask indicated by the reference numeral 26. The chilling step can be skipped if a pressure chamber (not shown) is placed around the glass tubing, in which case the sealing-off of the glass tubing can be effected by a laser beam.

The method described above can be varied in obvious ways to accommodate itself to the evacuation, filling and sealing-off of other types of tubing such as copper tubing. Thus, copper tubing can be sealed by arranging for the formation of a droplet of solder across the bore of the tubing subsequent to filling. Alternatively, copper tubing if annealed, can be sealed by pinching off.

Where the gas to be introduced into the tubing is tritium, it can be stored in powdered uranium, the uranium being heated to effect release of the gas. To scavenge the residual gas in portion 13 of conduit 2 and in tube 8 subsequent to filling of small-bore tubing, it is merely necessary to cool the uranium so that it serves as both the source and the scavenger of the gas.

It will thus be seen that the objects set forth above, among those made apparent from the preceding description, are efficiently attained and, since certain changes may be made in carrying out the above method and in the constructions set forth without departing from the spirit and scope of the invention, it is intended that all matter contained in the above description and shown in the accompanying drawings shall be interpreted as illustrated and not in a limiting sense.

It is also to be understood that the following claims are intended to cover all of the generic and specific features of the invention herein described, and all statements of the scope of the invention which, as a matter of language, might be said to fall therebetween.

What is claimed is:

1. Apparatus for filling small-bore tubing with a gas and preventing contamination of same, comprising a pump-head including interior conduit means of large diameter and low impedance, exterior conduit means of large diameter communicating with said interior conduit means for connecting same to an exterior high-speed, high-vacuum pump, small-diameter conduit means communicating with said interior conduit means for connecting same with a source of said gas, said small-diameter conduit means having valve means therein, port means at one end of said interior conduit means for communicating with a mounting means for holding said small-bore tubing, clamp means for holding said mounting means in sealed relationship to said port means and plug means movable between first and second positions, said plug means in said first position providing for rapid evacuation of said interior conduit means, said small-diameter conduit means and said small-bore tubing when attached to said pump-head, said plug means in said second position sealing off said exterior conduit means and all but a minor portion of said interior conduit means from communication with said small-diameter conduit means and said small-bore tubing and providing for transfer of said gas from said source and said small-diameter conduit means through said minor portion of said interior conduit means to said small-bore tubing, the small size of said minor portion minimizing the quantity of said gas remaining in said pump-head after filling said tubing with gas.

2. The apparatus as defined in claim 1, further comprising oven means for raising the temperature of said tubing and any contents thereof to the point where volatile components are driven off.

3. The apparatus as defined in claim 1, further comprising chilling means for reducing the temperature of said tubing and any contents thereof.

4. The apparatus as defined in claim 1, further comprising sealing-off means for sealing said tubing proximate said mounting means and separating the major portion of said tubing from said mounting means.

5. The apparatus as defined in claim 1, further comprising a junction between said interior conduit means and said small-diameter conduit means and wherein said valve means is positioned proximate said junction for minimizing the volume of said gas remaining between said valve means and said interior conduit means after filling said tubing with said gas.

6. The apparatus as defined in claim 4, further comprising scavenger means for recovering gas remaining in the minor portion of said tubing held in said mounting means after separation of the major portion therefrom and the gas remaining in said interior conduit means and said small-diameter conduit means.

7. The apparatus as defined in claim 6, wherein said scavenger means is powdered uranium.

* * * * *